US007355149B2

(12) United States Patent
Watanabe

(10) Patent No.: US 7,355,149 B2
(45) Date of Patent: Apr. 8, 2008

(54) COIL UNIT, PROCESS FOR PRODUCING THE SAME, AND IMAGE HEATING APPARATUS

(75) Inventor: Koki Watanabe, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 11/299,964

(22) Filed: Dec. 13, 2005

(65) Prior Publication Data

US 2006/0138126 A1 Jun. 29, 2006

(30) Foreign Application Priority Data

Dec. 13, 2004 (JP) ..... 2004/359886

(51) Int. Cl.
*H05B 6/14* (2006.01)
*G03G 15/20* (2006.01)

(52) U.S. Cl. ..... 219/619; 219/672; 219/676; 399/328

(58) Field of Classification Search ..... 219/619, 219/670, 672–677; 399/328–335
See application file for complete search history.

(56) References Cited

U.S. PATENT DOCUMENTS

2004/0188420 A1* 9/2004 Nishida ..... 219/619
2006/0086721 A1 4/2006 Wakahara et al. ..... 219/619
2006/0086722 A1 4/2006 Takematsu et al. ..... 219/619
2006/0086725 A1 4/2006 Hosoi et al. ..... 219/619
2006/0086731 A1 4/2006 Shirakata et al. ..... 219/645
2006/0089314 A1 4/2006 Wakahara et al. ..... 514/21
2006/0204292 A1 9/2006 Kato et al. ..... 399/328

FOREIGN PATENT DOCUMENTS

| | | |
|---|---|---|
| JP | 51-109737 | 9/1976 |
| JP | 9-292786 | 11/1997 |
| JP | 2003-68442 | 3/2003 |

* cited by examiner

*Primary Examiner*—Philip H. Leung
(74) *Attorney, Agent, or Firm*—Fitzpatrick, Cella, Harper & Scinto

(57) ABSTRACT

An electromagnetic induction coil unit for use with an electromagnetic induction heating-type image heating apparatus includes magnetic flux generation means comprising an exciting coil and a magnetic core; a core holder for holding the magnetic core; a coil holder for holding the exciting coil and the core holder holding the magnetic core; and a resin cured after being poured in a liquid state into a structure in which the exciting coil and the coil holder, and the magnetic fore and the core holder are incorporated so as to integrally mold the exciting coil, the magnetic core, the core holder, and the coil holder.

3 Claims, 6 Drawing Sheets

COIL UNIT, PROCESS FOR PRODUCING THE SAME, AND IMAGE HEATING APPARATUS

FIELD OF THE INVENTION AND RELATED ART

The present invention relates to an image heating apparatus for heating an image on a recording material by an induction heating method. More specifically, the present invention relates to an induction heating-type image forming apparatus suitable for a gloss-imparting apparatus for imparting gloss to an image on a recording material and a fixing apparatus for fixing an image on a recording material.

The present invention also relates to an electromagnetic induction coil unit provided in an electromagnetic induction heating-type heating apparatus for heating a material to be heated by heat generated by an electromagnetic induction heat-generating member, and relates to a process for producing the electromagnetic induction coil unit.

In a Japanese Utility Model Laid-Open Application No. Sho 51-109737 (Document 1), an induction heating-type heating apparatus for generating Joule heat by inducing a current in a fixation roller by the action of magnetic flux has been disclosed. The induction heating-type heating apparatus is capable of directly causing the fixation roller to generate heat by utilizing generation of induction current, so that it achieves a fixation process at a higher efficiency than that of a heat roller-type fixing apparatus using a halogen heater as a heat source.

However, energy of alternating magnetic flux generated by an exciting coil constituting a part of magnetic flux generation means is consumed for increasing a temperature of the entire fixation roller as a heating medium, so that a large loss of heat dissipation is caused to occur. Further, a fixing energy density is liable to be lowered with respect to supplied energy, so that a high-efficiency heating apparatus has been desired.

In view of this problem, high-efficiency fixing apparatuses have been provided by causing the exciting coil to come near to the fixation roller as a heat generation member or concentrating a distribution of alternating magnetic flux of the exciting coil at a portion in the neighborhood of a fixation nip, in order to obtain high-density energy for fixation.

In addition thereto, an improvement in constitution of a magnetic flux generation means has been proposed, in order to realize a high-efficiency heating apparatus, in Japanese Laid-Open Patent Application (JP-A) No. Hei 9-292786 (Document 2). Further, as described in JP-A No. 2003-68442, a production process of a coil unit has been proposed in order to realize a high-efficiency heating apparatus.

However, in Documents 1 and 2, a core and a coil are formed by resin molding in separate steps, so that there arises a problem of a longer operation time. Further, the core and the coil are fixed with resin in different steps, so that a boundary surface is formed between the resins cured in the different steps. The boundary surface is readily broken, so that there has arisen such a problem that the boundary surface is peeled off or cracked. For this reason, the core and the coil fail to ensure a good positional accuracy.

Further, a magnetic flux generation efficiency of the exciting coil is largely affected depending on a distance between the exciting coil and the fixation roller, so that sealing molding by ejecting a liquid resin has been performed in order to bring the exciting coil into intimate contact with a coil holder as close as possible. However, a position of a resin ejection gate is close to the exciting coil, so that the entire exciting coil leaves the coil holder during the ejection of the liquid resin. As a result, a distance between the exciting coil and the fixation roller is alienated.

It becomes naturally possible to realize a high efficiency of generation of magnetic flux when the exciting coils are brought into intimate contact with each other. However, the gate is close to the exciting coil, so that the exciting coil is partially unwound to rather lower the efficiency.

SUMMARY OF THE INVENTION

An object of the present invention is to provide an electromagnetic induction coil unit, as a part of an electromagnetic induction heating-type heating apparatus for heating a member to be heated by heat generated by an electromagnetic induction heat-generating member, capable of realizing a high magnetic flux generation efficiency with less power consumption.

Another object of the present invention is to provide a process for producing such a coil unit.

A further object of the present invention is to provide an image heating apparatus including such a coil unit.

According to an aspect of the present invention, there is provided a coil unit for use with an image heating apparatus, comprising:

magnetic flux generation means comprising an exciting coil and a magnetic core;

a core holder for holding the magnetic core;

a coil holder for holding the exciting coil and the core holder holding the magnetic core; and a resin cured after being poured in a liquid state into a structure in which the exciting coil and the coil holder, and the magnetic fore and the core holder are incorporated so as to integrally mold the exciting coil, the magnetic core, the core holder, and the coil holder.

According to another aspect of the present invention, there is provided a process for producing a coil unit for being used in an image heating apparatus, comprising: magnetic flux generation means comprising an exciting coil and a magnetic core; a core holder for holding the magnetic core; and a coil holder for holding the exciting coil and the core holder holding the magnetic core; the process comprising:

a step of pouring a liquid resin between the exciting coil and the coil holder, into a periphery of a holding portion of the coil holder and the core holder, and into a periphery of a holding portion of the core holder and the magnetic core in a state in which the exciting coil and the coil holder, and the magnetic core and the core holder are incorporated into the coil unit; and a step of curing the liquid resin to fix the exciting coil, the magnetic core, the core holder, and the coil holder.

According to a further aspect of the present invention, there is provided an image heating apparatus, comprising:

magnetic flux generation means comprising an exciting coil and a magnetic core;

a core holder for holding the magnetic core;

a coil holder for holding the exciting coil and the core holder holding the magnetic core;

a resin cured after being poured in a liquid state into a structure in which the exciting coil and the coil holder, and the magnetic fore and the core holder are incorporated so as to integrally mold the exciting coil, the magnetic core, the core holder, and the coil holder; and a heat generation member, for generating heat by magnetic flux generated from the exciting coil.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENT

First Embodiment (1) Embodiment of Image Forming Apparatus

As described above, the present invention relates to an electromagnetic induction coil unit provided in an electromagnetic induction heating-type heating apparatus for heating a material to be heated by heat generated by an electromagnetic induction heat-generating member, and also relates to a process for producing the electromagnetic induction coil unit.

Figure 6:
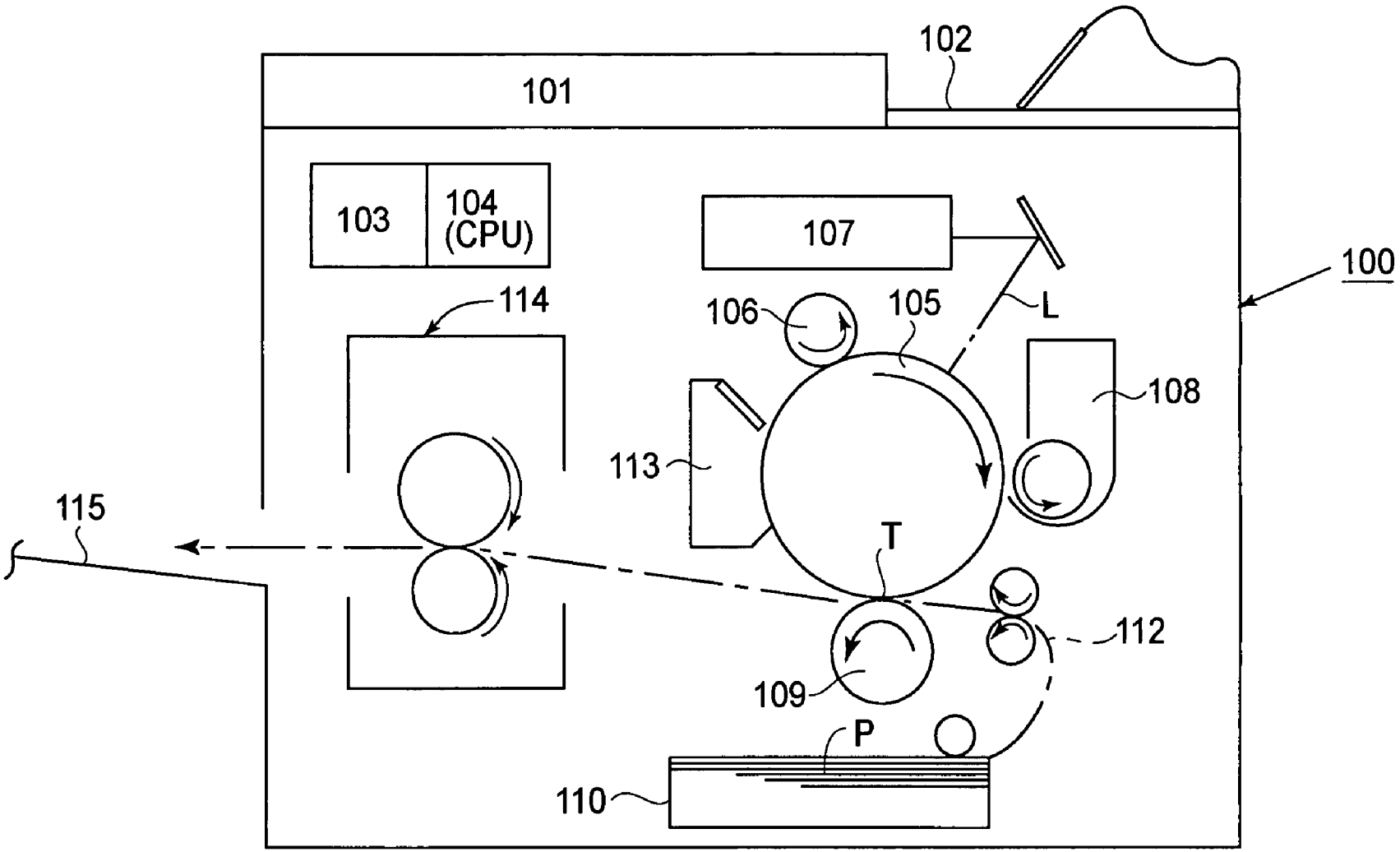
FIG. 6 is a schematic structural view of an embodiment of an image forming apparatus.

FIG. 6 is a schematic structural view of an embodiment of an image forming apparatus provided, as an image heat-fixing apparatus, with a heating apparatus of an electromagnetic induction heating type including an electromagnetic induction coil unit according to the present invention.

In this embodiment, an image forming apparatus 100 is a laser scanning exposure-type digital image forming apparatus (a copying machine, a printer, a facsimile machine, a multi-functional machine of these machines, etc.) utilizing a transfer-type electrophotographic process.

On an upper surface side of the image forming apparatus 100, an original reading apparatus (image scanner) 101 and an area designating apparatus (digitizer) 102 are disposed. The original reading apparatus 101 scans a surface of an original placed on a original supporting late of the apparatus with a scanning illumination optical system including a light source and others disposed inside the apparatus, and reads reflected light from the original surface with a photosensor, such as a CCD line sensor, to convert image information into a time-series electric digital pixel signal. The area designating apparatus 102 effects setting of, e.g., a reading area of the original to output a signal. A printer controller 103 outputs a print signal based on image data of an unshown personal computer etc. A controller (CPU) 104 receives the signals from the original reading apparatus 101, the area designating apparatus 102, the printer controller 103, etc., and executes signal processing for sending directions to respective portions of an image output mechanism and image forming sequence control.

In the image output mechanism, a rotary drum-type electrophotographic photosensitive member (hereinafter referred to as a "photosensitive drum") 105 as an image bearing member is rotationally driven in a clockwise direction of an indicated arrow at a predetermined peripheral speed. During the rotation, the photosensitive drum 105 is uniformly charged electrically to a predetermined polarity and a predetermined potential by a charging apparatus 106. The uniformly charged surface of the photosensitive drum 105 is exposed imagewise to light L by an image writing apparatus 107 to be reduced in potential at an exposure light part, whereby an electrostatic latent image corresponding to an exposure pattern on the surface of the photosensitive drum 105. The image writing apparatus 107 used in this embodiment is a laser scanner and outputs laser light L modulated according to image data signal-processed in the controller (CPU) 104 as a control means to scan, for exposure, the uniformly charged surface of the rotating photosensitive drum 105, thus forming an electrostatic latent image corresponding to the original image information.

Next, the electrostatic latent image is developed as a toner image with toner by a developing apparatus. The toner image is electrostatically transferred from the surface of the photosensitive drum 105 onto a recording material (transfer material) P, such as a sheet, an OHP sheet, and the like as a material to be heated, which has been supplied to a transfer portion T, of a transfer charging apparatus 109, opposite to the photosensitive drum 105 from a sheet (recording material) supply mechanism portion at predetermined timing.

The sheet supply mechanism portion of the image forming apparatus of this embodiment includes a sheet supply cassette portion 110 accommodating a recording material, and a recording material conveying portion 113 for conveying the recording material P which has been selectively fed from the sheet supply cassette portion on one sheet basis to the transfer portion T at predetermined timing. The recording material conveying portion 113 includes a recording material conveying roller 114 by which the recording material P is conveyed to the transfer portion T with a predetermined throughput.

The recording material P onto which the toner image has been transferred from the photosensitive drum 105 surface at the transfer portion is separated from the photosensitive drum 105 surface and conveyed to a fixing apparatus 116 by which an unfixed toner image is fixed on the recording material P, which is then discharged on an output tray 117 located outside the image forming apparatus.

On the other hand, the surface of the photosensitive drum 105 after the separation of the recording material P is cleaned by a cleaning apparatus 115 so as to remove residual toner remaining on the photosensitive drum 105. The photosensitive drum 105 is then repetitively subjected to image formation.

(2) Fixing Apparatus 116

Figure 1:
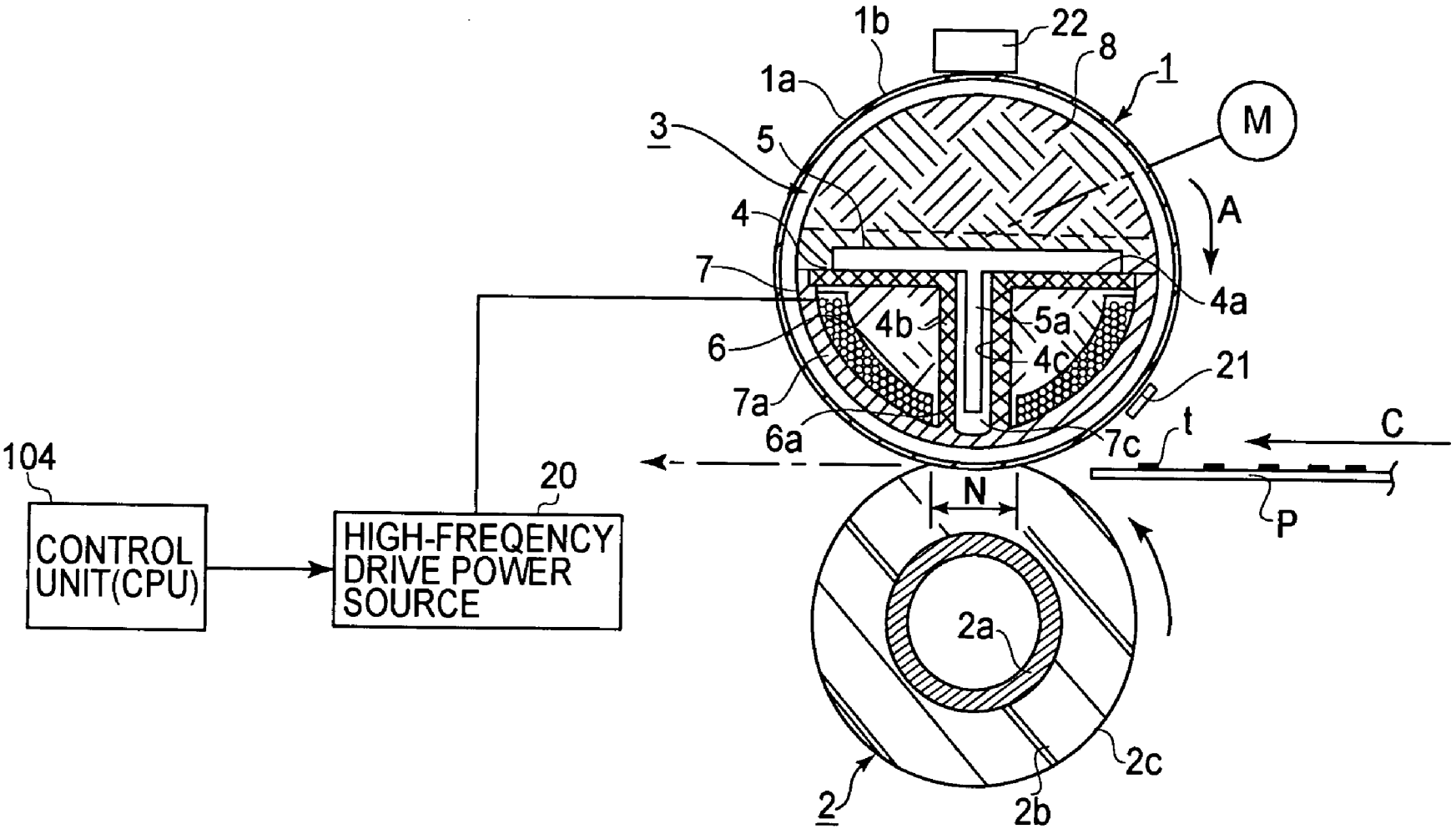
FIG. 1 is a schematic structural view of an embodiment of a fixing apparatus as an image heating apparatus according to the present invention.

FIG. 1 is a schematic structural view of an embodiment of the fixing apparatus 116 as the image heating apparatus according to the present invention.

These fixing apparatus 116 in this embodiment is of a heating roller type and is a heating apparatus of an electromagnetic induction heating type. The fixing apparatus 116 principally includes an induction heating-type rotary heating member or medium 1 (as an induction heating member) and a pressure roller 2 (as a pressure member) which are vertically disposed in parallel and pressed against each other at a predetermined pressing force to create a fixation (heating) nip portion N having a predetermined nip length (nip width).

The rotary heating roller (hereinafter referred to as a "fixation roller") 1 is a roller having a hollow (cylindrical) core metal (metal layer or electroconductive layer) 1*a* which is formed with an induction heating material, such as Ni, Fe, or SUS in a thickness of about 1.0 mm. At an outer peripheral surface of the core metal 1*a*, a heat-resistant release layer (heat conduction material) 1*b* is formed by coating the core metal with a fluorine-containing resin etc. The fixation roller 1 has a circumferential length of 35 mm and a length of 350 mm.

The fixation roller 1 is rotatably supported between frames (not shown), of the fixing apparatus, each via a bearing at both longitudinal end portions thereof. Further, at an inner hollow portion of the fixation roller 1, a coil unit 3, as a magnetic flux generation means, which generates a high-frequency magnetic field by inducing an induction current (eddy current) in the fixation roller 1 to cause Joule heat, is inserted and disposed.

The pressure roller 2 is a roller including an iron core shaft 2*a* having a thickness of about 3 mm, and a 5 mm-thick heat-resistant silicone rubber layer 2*b* which is wound around the core shaft 2*a*, and a 50 μm-thick PFA tube as a heat-resistant release layer 2*c* disposed on the heat-resistant rubber layer 2*b*. The pressure roller 2 is disposed under and in parallel with the fixation roller 1 and is rotatably held between the above described frames each via the bearing at both end portions thereof. The pressure roller 2 is further pressed against the lower surface of the fixation roller 1 by an unshown urging means while resisting an elasticity of the heat-resistant rubber layer 2*b*, thus forming the fixation nip portion N having the predetermined nip length as the heating portion.

The coil unit 3 includes a core holder 4 having a T-cross section, a magnetic core (core material) 5 which has a T-cross section and is formed of a magnetic material constituting the magnetic flux generation means, an exciting coil 6, and a coil holder 7 having such a cross section that it extends along an inner surface of the fixation roller 1 with a gap. The coil unit 3 is an assembly of the above described core, core holder, coil, and coil holder which are integrally molded with a resin 8 such as a liquid crystal polymer (LCP). The magnetic core 5 includes a center core 5*a* which is inserted into a through hole formed along a center supporting portion 4*b* extended from a side supporting portion 4*a*. The coil holder 7 includes an arcuate portion 7*a* having a semicircular shape along the inner surface of the fixation roller 1 with a gap and a center supporting portion 7*b* formed on the arcuate portion 7*a*. The core holder 4 is disposed so that an end of the side supporting portion 4*a* contacts an inner wall of the arcuate portion 7*a* of the coil holder 7 and an end of the center supporting portion 4*b* contacts an end of the center supporting portion 7*b* of the coil holder 7. The center supporting portion 7*b* is provided with a groove 7*c* in which an end of the center core 5*a* is inserted. The exciting coil 6 is formed by winding copper line so as to extending around the periphery of the supporting portion 7*b* of the coil holder 7 and along the inner wall of the arcuate portion 7*a*. For this reason, the exciting coil 6 is provided with a hole 6*a* into which the supporting portion 7*b* is to be inserted.

The core holder 4 and the coil holder are respectively formed of a single LCP. The exciting coil 6 is required to generate a sufficient alternating magnetic flux for heating, so that it is necessary to provide a low resistance component and a high inductance component. As a core wire of the exciting coil 6, a litz wire comprising a bundle of about 80-160 fine wires having a diameter of 0.1-0.3 mm. The fine wires comprise an insulating electric cable. The fine wires are wound around the center core 5*a* of the magnetic core 5 plural times along the shape of the flange of the coil holder 7 in an elongated board form, thus providing a wire-wound coil 6. As a result, the magnetic core 5 is disposed in the neighborhood of the center of winding of the exciting coil 6. The exciting coil 6 is wound in a longitudinal direction of the fixation roller 1. To the exciting coil 6, a high-frequency drive power source (exciting circuit) 20 is connected so as to supply a high-frequency current (AC) to the exciting coil 6.

As a material for the magnetic core 5, ferrite or the like having a high permeability and a low residual magnetic flux density. However, the material is not particularly limited so long as it is capable of generating magnetic flux. A shape of the magnetic core 5 is also particularly limited.

The above described coil unit 3 is fixed and supported in a frame in a non-rotational state by using a predetermined holding mechanism to form a certain gap between the inner surface of the fixation roller 1 and the coil holder 7. The coil unit 3 is accommodated so as not to be exposed to the outside of the fixation roller 1.

The above described fixation roller 1 is rotated in a clockwise direction indicated by an arrow A by being rotationally driven by means of a driving system M. The pressure roller 2 is rotated by the rotation of the fixation roller 1 in a counterclockwise direction indicated by an arrow B.

The drive power source 20 supplies the high-frequency current (AC) to the coil 6 of the coil unit 3 on the basis of a signal from a control unit (portion) 104. The coil 6 is excited by the high-frequency current supplied from the drive power source 20 to generate a high-frequency (AC) magnetic field in the longitudinal direction of the fixation roller 1. The AC magnetic field is guided in the magnetic core 5 to generate eddy current in the fixation roller 1 at the nip portion N. As a result, at the nip portion N, the fixation roller 1 is placed in an electromagnetic induction having state. Further, a surface temperature of the fixation roller 1 is uniformized by being rotationally driven.

On an outer peripheral surface of the fixation roller 1, a temperature sensor 21 as a temperature detection means for detecting a temperature of the fixation roller 1 is disposed. The temperature sensor 21 is disposed in contact with or close to the surface of the fixation roller 1 so as to be opposite to the exciting coil 6 through the fixation roller 1. Further, the temperature sensor 21, e.g., comprises a thermistor. By the thermistor, the temperature of the fixation roller 1 is detected and the drive power source 20 is controlled by the control unit 104 on the basis of a detection signal, so that energization of the exciting coil 6 is controlled so that the temperature of the fixation roller 1 is a fixation temperature (target temperature). The temperature sensor 20 may also be disposed in contact with or close to the inner surface of the fixation roller 1 so as to be opposite to the exciting coil 6.

A thermostat 22 is disposed on the fixation roller 1 as a safeguard mechanism at the time of abnormal rise in temperature of the fixation roller. The thermostat 22 is disposed in contact with or close to the surface of the fixation roller 1 and shuts off energization of the exciting coil 6 by releasing a contact when the temperature becomes a preliminarily set temperature, thus preventing the fixation roller 1 from being heated up to a temperature exceeding a predetermined temperature.

A recording material P onto which an unfixed toner image t is transferred in a rotational drive state of the fixation roller 1 and the pressure roller 2 is fed from a direction indicated by an arrow C into the nip portion N. At the nip portion N, the recording material P is conveyed while being sandwiched between the fixation roller 1 and the pressure roller 2. During the conveyance, heat by the heated fixation roller 1 and a pressure supplied from the pressure roller are applied to the recording material P, whereby the unfixed toner image t is fixed on the recording material P to form a fixed toner image. The recording material P passed through the nip portion N is curvature-separated from the surface of the fixation roller 1 to be conveyed in a left direction in FIG. 1.

(3) Production Process of Coil Unit 3

Figure 2:
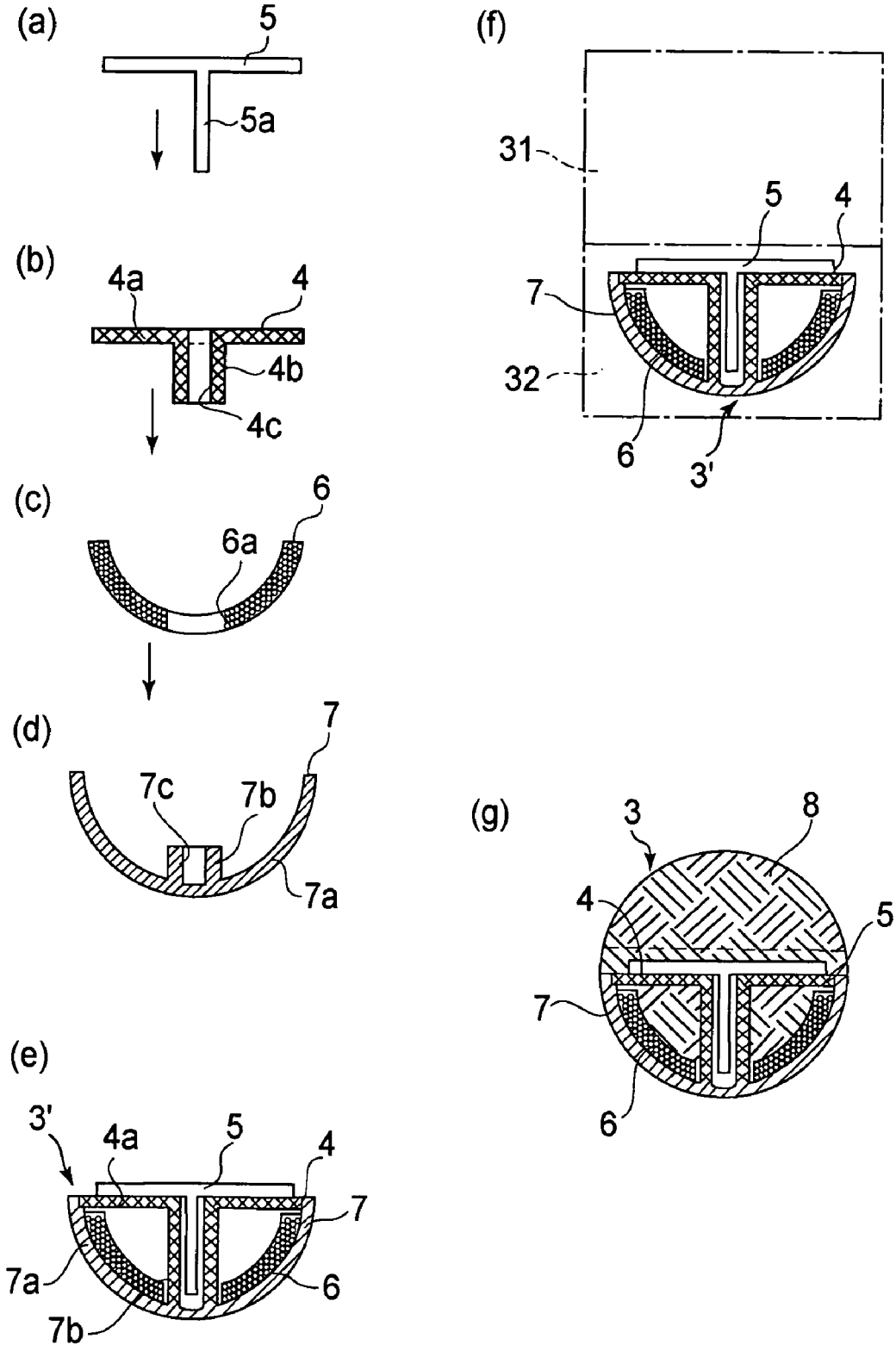
FIGS. 2(*a*) to 2(*g*) are schematic views for illustrating an example of production steps of a coil unit of the present invention.
Figure 3:
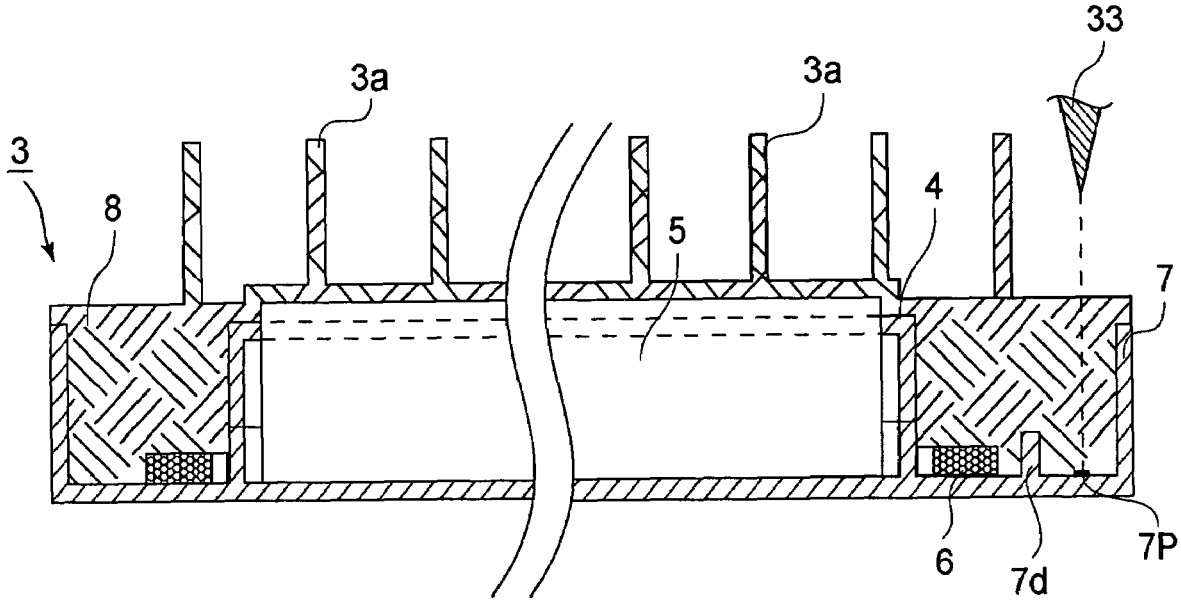
FIG. 3 is a longitudinal cross-sectional view of the coil unit.

FIGS. 2(*a*) to 2(*g*) are explanatory views of an example of production steps of the coil unit 3.

Referring to FIGS. 2(*a*) to 2(*d*), first of all, the center core 5*a* of the magnetic core 5 is inserted into the through hole 4*c* of the core holder 4. Then, into the hole 6*a* of the exciting coil 6, the center supporting portion 4*b* and the center supporting portion 7*b* are inserted so as to sandwich the exciting coil 6 between the core holder 4 and the coil holder 7. As a result, the core holder 4, the magnetic core 5, the exciting coil 6, and the coil holder 7 are preliminarily assembled as a temporary coil unit 3'. In the temporary coil unit 3', the coil holder 7 holds the exciting coil 6 at the inner wall of the arcuate portion 7*a* and holds the side supporting portion 4*a* of the core holder 4 at the inner wall of the end of the arcuate portion 7*a*. Further, the core holder 4 holds the magnetic core 5 at the upper surface of the side supporting portion 4*a*. The center core 5*a* of the magnetic core 5 is inserted into the through hole 4*c* of the core holder 4, so that clearance or looseness is not caused to occur during assembly. Accordingly, the magnetic core 5 can be incorporated at a normal position.

After completion of preliminary assembly of the coil unit 3', as shown in FIG. 2(*f*), the coil unit 3' is set in metal molds 31 and 32 for resin molding so as to perform integral molding.

Into the coil unit 3' preliminarily assembled and set in the metal molds 31 and 32, LCP 8 is injected in a liquid state, so that the exciting coil 6, the magnetic core 5, the coil holder 7, and the core holder 3 are integrally molded. This molding is recently referred to as "seal molding" in some cases. By the liquid LCP 8 for seal molding, it is possible to fill respective gaps among the exciting coil 6, the magnetic core 5, the coil holder 7, and the core holder 4. More specifically, a gap between the exciting coil 6 and the core holder 4, a gap at a periphery of the coil holder 7 and the core holder 4, and a gap at a periphery of the core holder 4 and the magnetic core 5 can be filled with the liquid LCP 8. As a result, a coil unit 3 as shown in FIG. 2(*g*) can be produced.

In order to improve a strength of the coil unit 3, it is also possible to provide ribs 3*a* to the coil unit 3 by using the LCP 8 for seal molding.

During the seal molding, a gate 33 for injecting the liquid LCP 8 is disposed at a position so that there is no exciting coil 6 in an injection direction of the LCP 8. In other words, the gate 33 is disposed at a position so that the liquid LCP 8 during the seal molding does not directly impinge on the exciting coil 6. By doing so, the injected liquid LCP 8 once impinges on the inner wall of the coil holder 7 at an impinging point 7P and is caused to flow into a portion, of the exciting coil 6, apart from the coil holder 7 in reaction to the impingement. For this reason, the exciting coil 6 can be brought into intimate contact with the inner wall of the coil holder 7.

As described above, the exciting coil 7 is successfully fixed permanently on the inner wall of the coil holder 7 while being brought in intimate contact with the coil holder 7, so that it is possible to stabilize magnetic flux generated from the coil unit 3 for a long period of time.

Further, magnetic flux in the longitudinal direction of the coil unit 3 is also stabilized and an irregularity in temperature control in the longitudinal direction is alleviated, so that it becomes possible to provide a user with an appropriate fixability.

Figure 5:
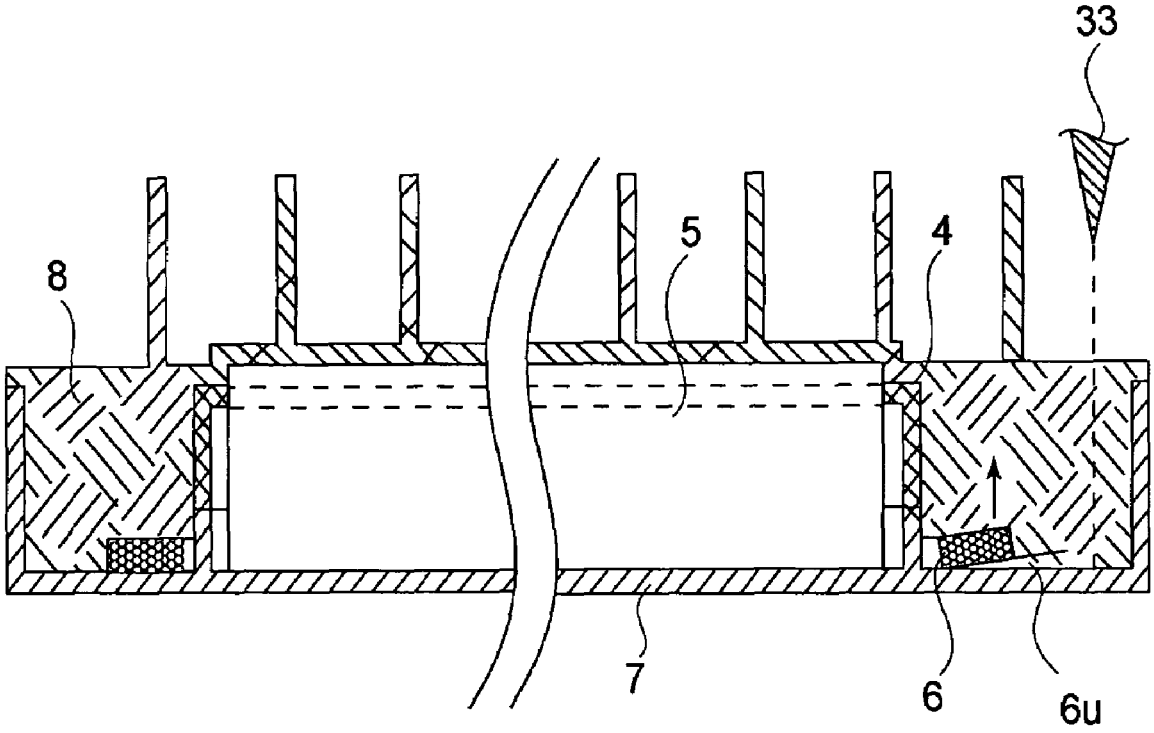
FIG. 5 is a schematic view for illustrating a separated portion of the exciting coil.

Further, in order to prevent the liquid LCP 8 from directly flowing between the coil holder 7 and the exciting coil 6, a flowing prevention rib 7*d* (as a shock-absorbing member for absorbing a shock during the flowing of the resin) is disposed between the impinging point 7P on the inner wall of the coil holder 7 and the exciting coil 6. As a result, the flowing prevention effect is further enhanced. In addition, it is possible to prevent an occurrence of a separated portion 6*u* of the exciting coil 7 caused due to separation of the entire exciting coil 6 from the inner wall of the coil holder 7 during the injection of the liquid LCP 8 (FIG. 5). As a result, it is possible to obviate alienation of a distance between the exciting coil 6 and the fixation roller 1.

Further, the gate 33 is disposed at such a position that the liquid LCP 8 does not directly impinge during the seal molding, so that the exciting coil 6 can be brought in intimate contact with the inner wall of the coil holder 7. Accordingly, the number C2 of fine wires of the exciting coil 6 contacting the coil holder after the seal molding (FIG. 4(*b*)) is larger than the number C1 of fine wires of an exciting coil 6' contacting the coil holder 7 in no lead state (FIG. 4(*a*)).

For this reason, the exciting coil 6 is successfully held hermetically on the inner wall of the coil holder 7 and permanently fixed thereon, so that magnetic flux generated from the coil unit 3 is stabilized for a long period of time.

The gate 33 is located at the position such that the liquid LCP 8 does not directly impinge on the exciting coil 6 during the seal molding, whereby it is possible to prevent the bundle of aligned fine wires of the exciting coil 6 from being disturbed by the liquid LCP 8 flowing into the exciting coil 6 in a turbulent flow-like state. As a result, it is possible to prevent the liquid LCP 8 from entering into a gap between individual fine wires of the exciting coil 6, so that a cross-sectional area of the exciting coil portion is decreased to bring the individual fine wires in intimate contact with each other.

Further, the magnetic flux in the longitudinal direction of the coil unit 3 is stabilized and an irregularity in temperature control in the longitudinal direction is alleviated to provide a user with an appropriate fixability.

Figure 4:
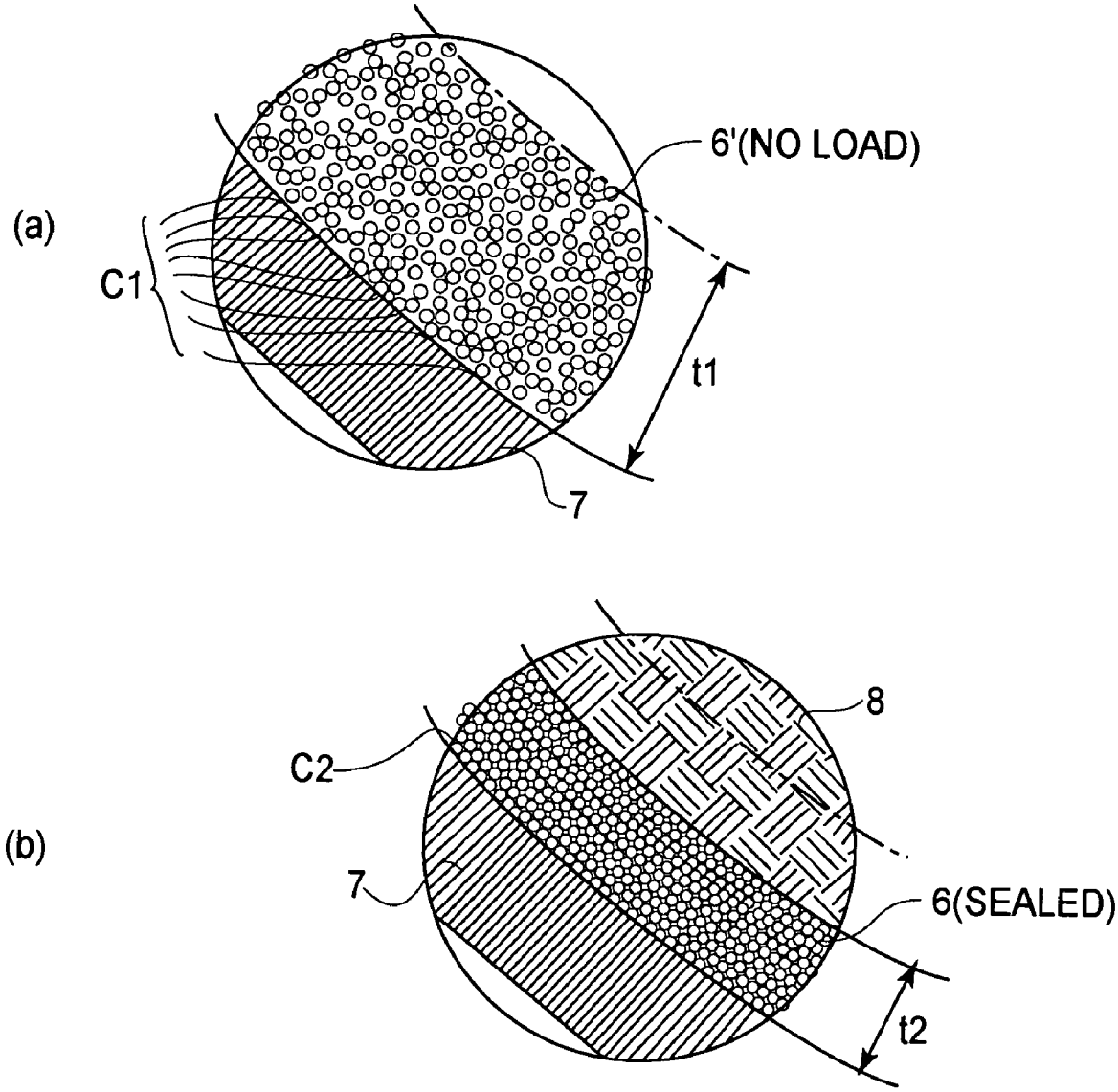
FIGS. 4(*a*) and 4(*b*) are schematic views of an exciting coil in no lead state (4(*a*)) and in a sealed state (4(*b*)).

Further, by the seal molding, a thickness t2 of the exciting coil 6 after the seal molding (FIG. 4(*b*)) is smaller than a thickness t1 of the exciting coil 6' in no load state (FIG. 4(*a*)), so that an output of the coil unit 3 is further improved.

The exciting coil itself is increased in temperature by its own output, so that the temperature thereof exceed 200° C. higher than a fixing temperature in some cases. In such cases, the resin contacting the exciting coil 6 causes corresponding thermal fatigue. For this reason, all the resins contacting the exciting coil 6 are made a single heat-resistant resin, whereby a durability is stabilized. In the present invention, resins for the coil holder 7 and the core holder 4, and the resin for the seal molding correspond to such resins contacting the exciting coil 6.

According to this embodiment, as described above, it is possible to integrally mold the exciting coil 6, the magnetic core 5, the core holder 4, and the coil holder 7 with the LCP 8. As a result, the magnetic core 5 having a poor dimension stability can be permanently held and fixed at a certain position in the coil unit 3. Accordingly, it is possible to achieve high efficiency of magnetic flux generation with less power consumption.

Further, the cross-sectional area of the exciting coil 6 after the seal molding can be decreased by the seal molding to increase a contact area of the individual fine wires of the exciting coil 6. As a result, a loss of magnetic flux is reduced, so that the magnetic flux generated from the exciting coil 6 can be obtained efficiently.

Further, by the seal molding, the contact area between the exciting coil 6 and the coil holder 7 after the seal molding is increased, so that a spatial distance between the fixation roller 1 and the exciting coil 6 is always stabilized. As a result, the magnetic flux generated from the exciting coil 6 can efficiently act on the fixation roller 1.

Further, the materials contacting the exciting coil 6 is made an identical material, whereby a durability control in combination with the exciting coil 6 becomes easy to reduce production costs.

The injected resin does not directly impinge on the exciting coil 6, so that the cross-sectional shape of the exciting coil 6 can be kept as an appropriate shape, thus permitting a production process capable of stably providing the shape.

Further, the coil holder 7 is provided with the rib 7*d*, so that the cross-sectional shape of the exciting coil 6 can be further appropriately kept, thus permitting the production process capable of stably providing the shape.

Further, it is possible to provide a very high-efficiency fixing apparatus capable of contributing to recent energy saving.

According to the present invention, the core and the coil are integrally formed in a single step, so that an operation time is reduced. In addition, the coil and the core are not fixed with resin in separate steps, so that there is no boundary surface created between the resins cured in the separate steps. As a result, it is possible to provide a stable coil unit excellent in strength.

Other Embodiments

1) The heating apparatus of the electromagnetic induction heating type according to the present invention is not limited to be used as the image heat-fixing apparatus as in the above described embodiment but is also effective as a provisional fixing apparatus for provisionally fixing an unfixed image on a recording sheet or an image heating apparatus such as a surface modification apparatus for modifying an image surface characteristic such as glass by reheating a recording sheet carrying thereon a fixed image. In addition, the heating apparatus of the present invention is also effective as a heating apparatus for heat-treating a sheet-like member, such as a hot press apparatus for removing rumples of bills or the like, a hot laminating apparatus, or a hot-drying apparatus for evaporating a moisture content of paper or the like.

2) The shape of the heating medium is not limited to the roller shape but may be other rotational body shapes, such as an endless belt shape. The heating medium may be constituted by not only a single induction heating member or a multilayer member having two or more layers including an induction heating layer and other material layers of heat-resistant plastics, ceramics, etc.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 359886/2004 filed Dec. 13, 2004, which is hereby incorporated by reference.

What is claimed is:

1. A coil unit comprising:

a coil for generating a magnetic flux by energization;

a coil holder for holding said coil;

a magnetic core;

a supporting portion for supporting said magnetic core;

a first resin portion at which a liquid resin material is injected into a space between said coil and said supporting portion and is cured in a state with said coil mounted to said coil holder, said coil being covered with said coil holder and said first resin portion; and a second resin portion at which a liquid resin material is injected in a state with said magnetic core mounted to said supporting portion, said magnetic core being covered with said supporting portion and said second resin portion.

2. A coil unit according to claim 1, wherein said coil holder and said supporting member are molded with the resin material.

3. A coil unit according to claim 1, wherein said coil unit further comprises a heat generating member and is used in an image heating apparatus for heating an image on a recording material.

* * * * *

UNITED STATES PATENT AND TRADEMARK OFFICE

CERTIFICATE OF CORRECTION

PATENT NO. : 7,355,149 B2
APPLICATION NO. : 11/299964
DATED : April 8, 2008
INVENTOR(S) : Koko Watanabe It is certified that error appears in the above-identified patent and that said Letters Patent is hereby corrected as shown below:

COLUMN 2
Line 34, “fore” should read --core--.
Line 63, “fore” should read --core--.

COLUMN 3
Line 53, “a” should read --an--, and “late” should read --plate--.
Line 62, “computer” should read --computer,--.

COLUMN 4
Line 12, “corresponding” should read --corresponds--.

COLUMN 5
Line 11, “resin” should read --resin,--.
Line 29, “above described” should read --above-described--.
Line 42, “above described” should read --above-described--.
Line 59, “extending” should read --extend--.

COLUMN 6
Line 2, “comprising” should read --comprises--.
Line 17, “having” should read --has--.
Line 21, “above described” should read --above-described--.
Line 27, “above described” should read --above-described--.

UNITED STATES PATENT AND TRADEMARK OFFICE

CERTIFICATE OF CORRECTION

PATENT NO. : 7,355,149 B2
APPLICATION NO. : 11/299964
DATED : April 8, 2008
INVENTOR(S) : Koko Watanabe It is certified that error appears in the above-identified patent and that said Letters Patent is hereby corrected as shown below:

COLUMN 8
Line 35, “lead” should read --load--.
Line 61, “exceed” should read --exceeds--.

COLUMN 9
Line 23, “is” should read --are--.
Line 24, “an” should read --of an--.
Line 51, “above” should read --above- --.

Signed and Sealed this

Third Day of February, 2009

JOHN DOLL
*Acting Director of the United States Patent and Trademark Office*